United States Patent [19]

Beck

[11] Patent Number: 4,557,333

[45] Date of Patent: Dec. 10, 1985

[54] LOW PRESSURE RESPONSIVE DOWNHOLE TOOL WITH CAM ACTUATED RELIEF VALVE

[75] Inventor: Harold K. Beck, Duncan, Okla.

[73] Assignee: Halliburton Company, Duncan, Okla.

[21] Appl. No.: 533,834

[22] Filed: Sep. 19, 1983

[51] Int. Cl.[4] ..... E21B 34/10

[52] U.S. Cl. ..... 166/374; 166/321; 166/332

[58] Field of Search ..... 166/264, 319, 321, 323, 166/324, 330, 331, 332, 374, 387

[56] References Cited

U.S. PATENT DOCUMENTS

| | | | |
|---|---|---|---|
| Re. 29,562 | 3/1978 | Wray et al. | 166/336 |
| 2,740,479 | 4/1956 | Schwegman | 166/145 |
| 3,358,755 | 12/1967 | Chisholm | 166/264 |
| 3,431,985 | 3/1969 | Bowen | 173/119 |
| 3,646,995 | 3/1972 | Manes et al. | 166/336 |
| 3,664,415 | 5/1972 | Wray et al. | 166/321 |
| 3,782,461 | 1/1974 | Watkins | 166/322 |
| 3,823,773 | 7/1974 | Nutter | 166/321 |
| 3,842,913 | 10/1974 | Mott | 166/374 |
| 3,850,250 | 11/1974 | Holden et al. | 166/374 |
| 3,856,085 | 12/1974 | Holden et al. | 166/264 |
| 3,858,649 | 1/1975 | Wray et al. | 166/264 |
| 3,860,069 | 1/1975 | Wray et al. | 166/264 |
| 3,870,104 | 3/1975 | Mott | 166/322 |
| 3,915,228 | 10/1975 | Giebeler | 166/321 |
| 3,930,540 | 1/1976 | Holden et al. | 166/321 |
| 3,964,305 | 6/1976 | Wray et al. | 166/321 |
| 3,964,544 | 6/1976 | Farley et al. | 166/264 |
| 3,976,136 | 8/1976 | Farley et al. | 166/321 |
| 4,047,564 | 9/1977 | Nix et al. | 166/334 |
| 4,058,165 | 11/1977 | Holden et al. | 166/321 |
| 4,059,153 | 11/1977 | Nix et al. | 166/264 |
| 4,063,593 | 12/1977 | Jessup | 166/321 |
| 4,076,077 | 2/1978 | Nix et al. | 166/321 |
| 4,109,724 | 8/1978 | Barrington | 166/321 |
| 4,109,725 | 8/1978 | Williamson et al. | 166/321 |
| 4,113,012 | 9/1978 | Evans et al. | 166/321 |
| 4,144,937 | 3/1979 | Jackson et al. | 166/324 |
| 4,341,266 | 7/1982 | Craig | 166/317 |

OTHER PUBLICATIONS

*Primary Examiner*—Stephen J. Novosad
*Assistant Examiner*—Bruce M. Kisliuk
*Attorney, Agent, or Firm*—L. Wayne Beavers; James R. Duzan; Thomas R. Weaver

[57] ABSTRACT

An annulus pressure responsive downhole tool includes a housing having a power piston slidably disposed therein. First and second pressure conducting passages communicate a well annulus with first and second sides of the power piston. A retarding device is disposed in the second pressure conducting passage for delaying communication of a sufficient portion of an increase in well annulus pressure to the second side of the power piston for a sufficient time to allow a pressure differential across the power piston to move the power piston from a first position to a second position relative to the housing. A pressure relief valve is communicated with the second pressure conducting passage between the power piston and the retarding device for relieving from the second pressure conducting passage a volume of fluid sufficient to permit the power piston to travel to its second position. The pressure relief valve is opened by mechanical action when the power piston starts to move toward its second position.

20 Claims, 8 Drawing Figures

LOW PRESSURE RESPONSIVE DOWNHOLE TOOL WITH CAM ACTUATED RELIEF VALVE

BACKGROUND OF THE INVENTION

1. Field of the Invention

The present invention relates to annulus pressure responsive downhole tools. Particularly, the present invention provides an improved design for an annulus pressure responsive downhole tool which eliminates the need for using a large volume of compressible liquid or a volume of compressible gas within the tool to compensate for the volume displaced by a power piston of the tool.

2. Description of the Prior Art

It is well known in the art that downhole tools such as testing valves, circulating valves and samplers can be operated by varying the pressure of fluid in a well annulus and applying that pressure to a differential pressure piston within the tool.

The predominant method of creating the differential pressure across the differential pressure piston has been to isolate a volume of fluid within the tool at a fixed reference pressure. Such a fixed reference pressure has been provided in any number of ways.

One manner of providing a fixed reference pressure is by providing an essentially empty sealed chamber on the low pressure side of the power piston, which chamber is merely filled with air at the ambient pressure at which the tool was assembled. Such a device is shown for example in U.S. Pat. No. 4,076,077 to Nix et al. with regard to its sealed chamber 42. This type of device does not balance hydrostatic annulus pressure across the power piston as the tool is run into the well.

Another approach has been to provide a chamber on the low pressure side of the piston, and fill that chamber with a charge of inert gas such as nitrogen. Then, when the annulus pressure overcomes the gas pressure, the power piston is moved by that pressure differential, and the gas compresses to allow the movement of the power piston. Such a device is shown for example in U.S. Pat. No. 3,664,415 to Wray et al. with regard to its nitrogen cavity 44. This type of device does not balance hydrostatic annulus pressure across the power piston as the tool is run into the well.

Another approach has been to use a charge of inert gas as described above, in combination with a supplementing means for supplementing the gas charge pressure with the hydrostatic pressure of the fluid in the annulus contained between the well bore and the test string, as the test string is lowered into the well. Such a device is shown for example in U.S. Pat. No. 3,856,085 to Holden et al. When a tool of this type has been lowered to the desired position in the well, the inert gas pressure is supplemented by the amount of the hydrostatic pressure in the well at that depth. Then, an isolation valve is closed which then traps in the tool a volume of well annulus fluid at a pressure substantially equal to the hydrostatic pressure in the well annulus at that depth. Once the isolation valve has closed, the reference pressure provided by the inert gas is no longer effected by further increases in well annulus pressure. Then well annulus pressure may be increased to create a pressure differential across the power piston to actuate the tool.

Also, rather than utilize a compressible inert gas such as nitrogen within such tools, it has been proposed to use a large volume of a somewhat compressible liquid such as silicone oil on the low pressure side of the piston. Such a device is seen for example in U.S. Pat. No. 4,109,724 to Barrington.

One recent device which has not relied upon either a large volume of compressible liquid or a volume of compressible gas is shown in U.S. Pat. No. 4,341,266 to Craig. This is a trapped reference pressure device which uses a system of floating pistons and a differential pressure valve to accomplish actuation of the tool. The reference pressure is trapped by a valve which shuts upon the initial pressurizing up of the well annulus after the packer is set. The Craig tool does balance hydrostatic pressure across its various differential pressure components as it is run into the well.

Another relatively recent development is shown in U.S. Pat. No. 4,113,012 to Evans et al. This device utilizes fluid flow restrictors 119 and 121 to create a time delay in any communication of changes in well annulus pressure to the lower side of its power piston. During this time delay the power piston moves from a first to a second position. The particular tool disclosed by Evans et al. utilizes a compressed nitrogen gas chamber in combination with a floating shoe which transmits the pressure from the compressed nitrogen gas to a non-compressible liquid filled chamber. This liquid filled chamber is communicated with a well annulus through pressurizing and depressurizing passages, each of which includes one of the fluid flow restrictors plus a back pressure check valve. Hydrostatic pressure is balanced across the power piston as the tool is run into the well, except for the relatively small differential created by the back pressure check valve in the pressurizing passage.

With most of these prior art devices, there has been the need to provide either a large volume of compressible liquid or a volume of compressible gas to account for the volume change within the tool on the low pressure side of the power piston. This compressible liquid or gas has generally either been silicone oil or nitrogen. There are disadvantages with both of these.

When utilizing a tool which provides a sufficient volume of compressible silicone oil to accommodate the volume change required on the low pressure side of the power piston, the tool generally becomes very large because of the large volume of silicone oil required in view of its relatively low compressibility.

On the other hand, there is a danger in tools that utilize an inert gas, such as nitrogen, as in any high pressure vessel.

Furthermore, most of these prior art tools have required relatively high annulus pressure increases, sometimes as high as 2000 psi, for operation.

SUMMARY OF THE INVENTION

The present invention provides a very much improved annulus pressure responsive tool which operates in response to a relatively low increase in annulus pressure, and which also eliminates the problems of dealing with either a large volume of compressible liquid or a pressurized volume of compressible gas in order to provide for the volume change on the low pressure side of the moving power piston.

The present invention provides an annulus pressure responsive downhole tool apparatus which includes a tool housing having a power piston slidably disposed in the housing. A first pressure conducting passage communicates the well annulus with a first side of the power piston. A second pressure conducting passage communicates the well annulus with a second side of the power piston. A retarding means, is disposed in the second pressure conducting passage for delaying communication of a sufficient portion of an increase in well annulus pressure to the second side of the power piston for a sufficient time to allow a pressure differential from the first side to the second side of the power piston to move the power piston from a first position to a second position relative to the housing. A pressure relief means is communicated with the second pressure conducting passage, between the second side of the piston and the retarding means, for relieving from the second pressure conducting passage a volume of fluid sufficient to permit the power piston to travel to its second position.

The pressure relief means includes a cam actuated flapper type valve which is mechanically opened when the power piston starts to move toward its second position.

It is this pressure relief means, which relieves fluid from the low pressure side of the power piston, which eliminates the need for using either a compressible gas or a large volume of compressible liquid on the low pressure side of the power piston.

The use of the pressure relief means to accommodate the fluid displaced by the power piston, instead of using a large volume of compressible liquid or a pressurized volume of gas provides a number of advantages.

Since no pressurized nitrogen is used, the dangers associated with the use of pressurized nitrogen are eliminated.

Very significantly, the pressures which must be applied to the well annulus to operate the tools of the present invention are very much reduced as compared to most prior art tools.

Also, the present invention provides a tool which always actuates at the same differential operating pressure. Tools which rely upon compressible liquids or compressible gas do not have constant differential operating pressures because the compressibility of the silicone oil and the nitrogen is non-linear.

The tools of the present invention can be operated with a differential operating pressure of as little as 200–500 psi. This is determined by the strength of the return spring located below the power piston. Thus, if an actual well annulus pressure increase of 1000 psi is used to actuate the tool of the present invention, a wide margin of error is provided assuring that the tool will in fact be actuated.

Prior art tools, particularly those relying upon the compression of silicone oil, require much higher differential operating pressures as high as 2000 psi.

This is particularly important in view of the fact that, assuming the tool in question is a tester valve, the other tools in the test string, such as circulating valves for example, have to be set to operate at a differential operating pressure greater than that of the tester valve. Typically, it is undesirable to increase the well annulus pressure greater than about 3000 psi because of limits on the strength of the well casing. The present invention, therefore, allows the differential operating pressures of the various tools in the testing string to be spaced further apart, and also generally allows those pressures to be decreased. This improves both the safety and the reliability of operation of the entire testing string.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
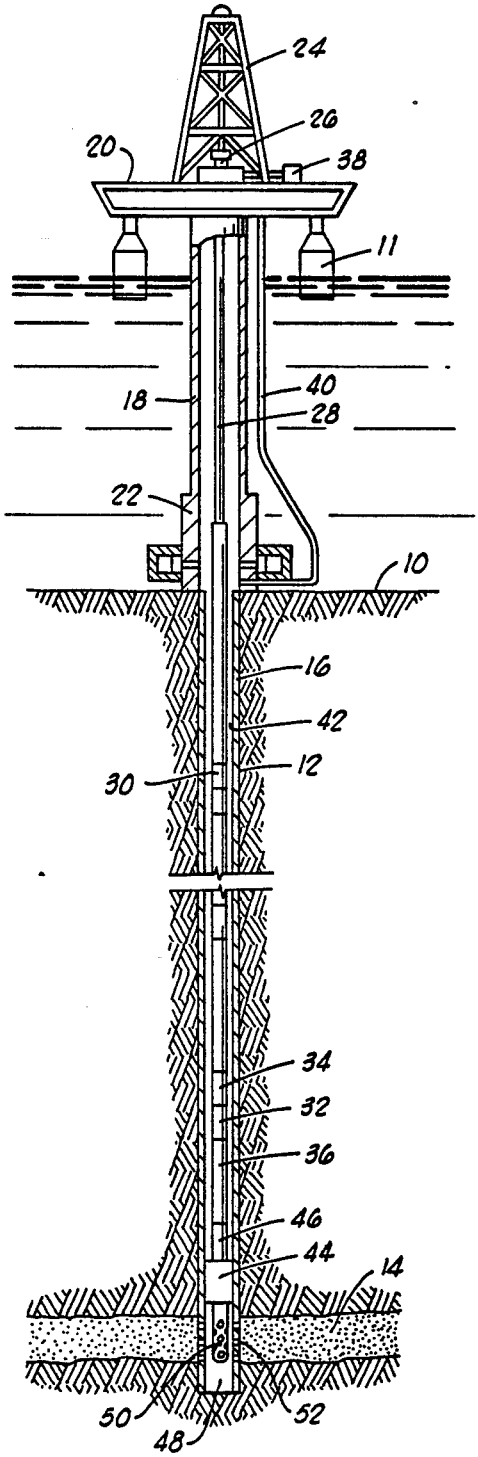
FIG. 1 is a schematic elevation view of an offshore well showing a well test string in place within the well bore.

Referring now to the drawings, and particularly to FIG. 1, the downhole tool of the present invention is shown in a testing string for use in an offshore oil or gas well.

In FIG. 1, a floating work station 11 is centered over a submerged oil or gas well located in the sea floor 10 having a bore hole 12 which extends from the sea floor 10 to a submerged formation 14 which is to be tested. The bore hole 12 is typically lined by a steel liner or casing 16 which is cemented into place.

A subsea conduit 18 extends from a deck 20 of the floating work station 11 into a well head installation 22. The floating work station 11 has a derrick 24 and hoisting apparatus 26 for raising and lowering tools to drill, test and complete the oil or gas well.

A testing string 28 is shown after it has been lowered into the bore hole 12 of the oil or gas well. The testing string 28 includes such tools as a slip joint 30 to compensate for the wave action of the floating work station 11 as the testing string 28 is being lowered into place, a tester valve 32 and a circulation valve 34. Also, a check valve assembly 36 may be located in the testing string 28 below the tester valve 32.

The tester valve 32, circulation valve 34, and check valve assembly 36, are operated by fluid annulus pressure exerted by a pump 38 located on the deck 20 of the floating work station 11. Pressure changes are transmitted by a pipe 40 to a well annulus 42 between the casing 16 and the testing string 28.

Annulus pressure in the well annulus 42 is isolated from the formation 14 to be tested by a packer 44 set in the well casing 16 just above the formation 14.

The testing string 28 also generally includes a tubing seal assembly 46 which stabs through a passageway through the production packer 44 forming a seal isolating an upper portion of the well annulus 42 above the packer 44 from an interior bore 48 of the well immediately adjacent the formation 14 and below the packer 44. The interior bore 48 may also be referred to as a lower portion of the well annulus 42 below the packer 44, it being understood that this lower portion 48 of the well annulus 42 is not necessarily annular in shape, but instead includes whatever portion of the well cavity there is below the packer 44.

A perforated tail piece 50, or other production tube, is located at the bottom end of the seal assembly 46 to allow formation fluids to flow from the formation 14 into a flow passage of the testing string 28. Formation fluid is admitted into the lower portion 48 of well annulus 42 through perforations 52 provided in the casing 16 adjacent the formation 14.

A testing string such as that illustrated may be used either to test formation flow from the formation 14, or treat the formation 14 by pumping liquids downward through the test string into the formation 14.

The present invention relates to low pressure responsive tools for use in such a test string.

The specific embodiment illustrated in the drawings and discussed below relates to a tester valve which would be located such as the tester valve 32 in the schematic illustration of FIG. 1.

The scope of the present invention, however, is such that it embodies more than just tester valves, and embodies any downhole tool apparatus which is operated in response to annulus pressure.

Thus the concepts about to be discussed can be utilized for tester valves, circulation valves, such as circulation valve 34 illustrated in FIG. 1, or also for example in sample chambers or the like which might be used with such a test string to trap a sample of the flowing fluid.

DESCRIPTION OF THE PREFERRED EMBODIMENT OF FIGS. 2A–2E

Referring now to FIGS. 2A–2E, an elevation half-section view is thereshown of a tester valve of the present invention, which tester valve is generally designated by the numeral 32. The tester valve 32 may generally be referred to as an annulus pressure responsive downhole tool apparatus 32.

The tester valve 32 includes a tool housing generally designated by the numeral 54. The tool housing 54 includes an upper adaptor 56, a valve housing section 58, a first middle adaptor 60, a power and relief housing section 800, a second middle adaptor 802, a cartridge housing section 804, and a lower adaptor 806.

An O-ring seal 70 is provided between upper adaptor 56 and valve housing section 58.

Valve housing section 58 and first middle adaptor 60 are joined at threaded connection 72 and a seal is provided therebetween by O-ring 74.

First middle adaptor 60 and power housing section 800 are joined together at threaded connection 76 and a seal is provided therebetween by O-ring 78.

Power and relief housing section 800 and second middle adaptor 64 are joined together at threaded connection 808 and a seal is provided therebetween by double O-ring seal means 810.

Second middle adaptor 802 and cartridge housing section 804 are joined together at threaded connection 812 and a seal is provided therebetween by double O-ring means 814.

Cartridge housing section 804 and lower adaptor 806 are joined together at threaded connection 816.

Disposed in the valve housing section 58 is a full opening ball valve means 90.

Figure 2A:
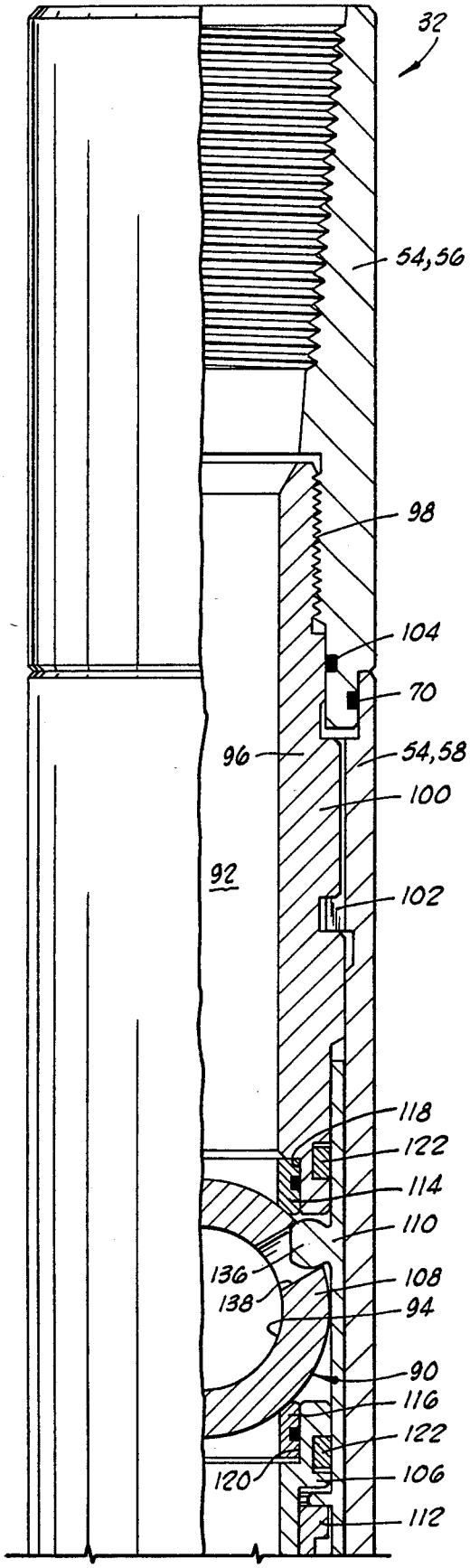
FIGS. 2A–2E comprise an elevation half-section view of the downhole tool of the present invention.

The ball valve means 90 is illustrated in FIG. 2A in its first closed position closing a central bore 92 of the tester valve 32. The ball valve means 90 may be rotated 90° relative to the housing 54 to an open position wherein a bore 94 of ball valve means 90 is aligned with central bore 92.

The ball valve means 90 includes an upper valve support 96 which is threadedly connected to upper adaptor 56 at threaded connection 98. Radially outwardly extending splines 100 of upper valve support 96 are engaged with radially inwardly extending splines 102 of valve section housing 58 to prevent relative rotation between those members. An O-ring seal 104 is provided between upper adaptor 56 and upper valve support 96.

Ball valve means 90 also includes a lower valve support 106, a ball 108, ball valve actuating arms 110 (only one of which is shown) and an actuating sleeve 112.

Upper and lower valve seats 114 and 116 are received within counterbores 118 and 120, respectively, of upper and lower valve supports 96 and 106. C-clamps 122 bias the upper and lower valve supports 96 and 106 toward each other so that the seats 114 and 116 are held in close engagement with the ball 108.

Figure 2B:
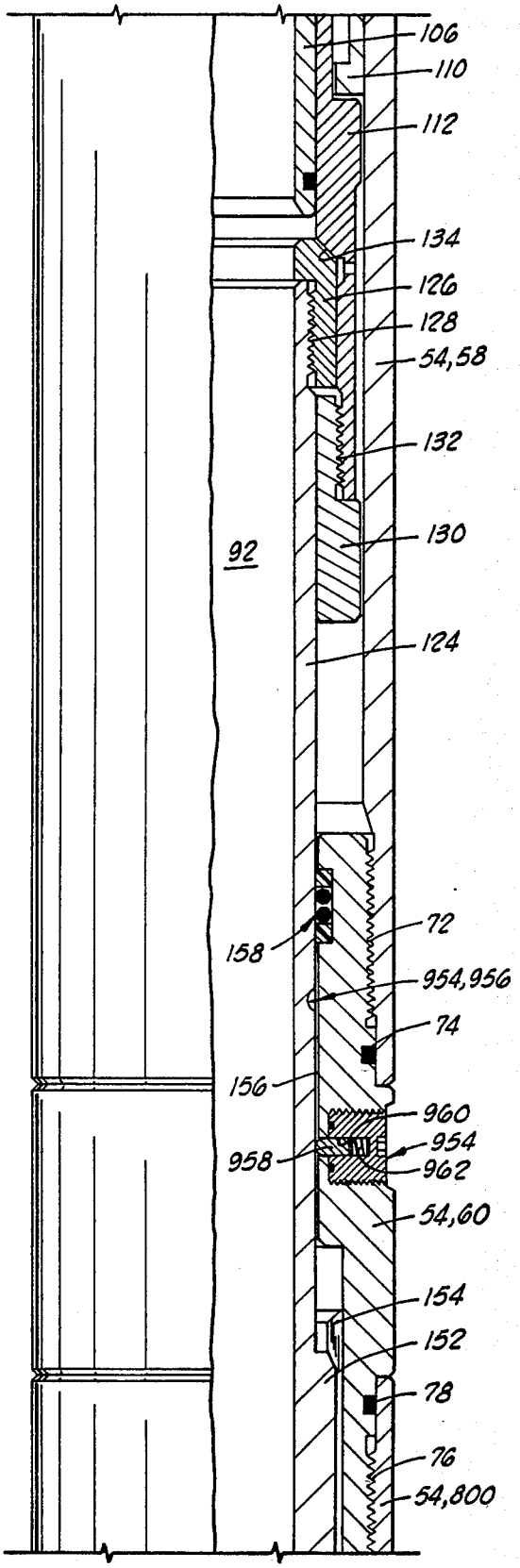

Referring now to FIG. 2B, a ball valve actuating mandrel 124 has its upper end received within actuating sleeve 112. An upper end collar 126 is threadedly connected to ball valve actuating mandrel 124 at threaded connection 128. A lower end collar 130 is threadedly connected to the lower end of actuating sleeve 112 at threaded connection 132 so that upper end collar 126 is trapped between lower end collar 130 and a downward facing shoulder 134 of actuating sleeve 112.

Thus, when ball valve actuating mandrel 124 is moved downward from the position illustrated in FIG. 2B, it pulls actuating sleeve 112 and ball valve actuating arms 110 downward relative to housing 54 so that a lug 136 of each ball valve actuating arm 110 which is received within an eccentric hole 138 of ball 108 causes the ball 108 to be rotated through an angle of 90° so that its bore 94 is aligned with the central bore 92 of the tester valve 32.

Figure 2C:
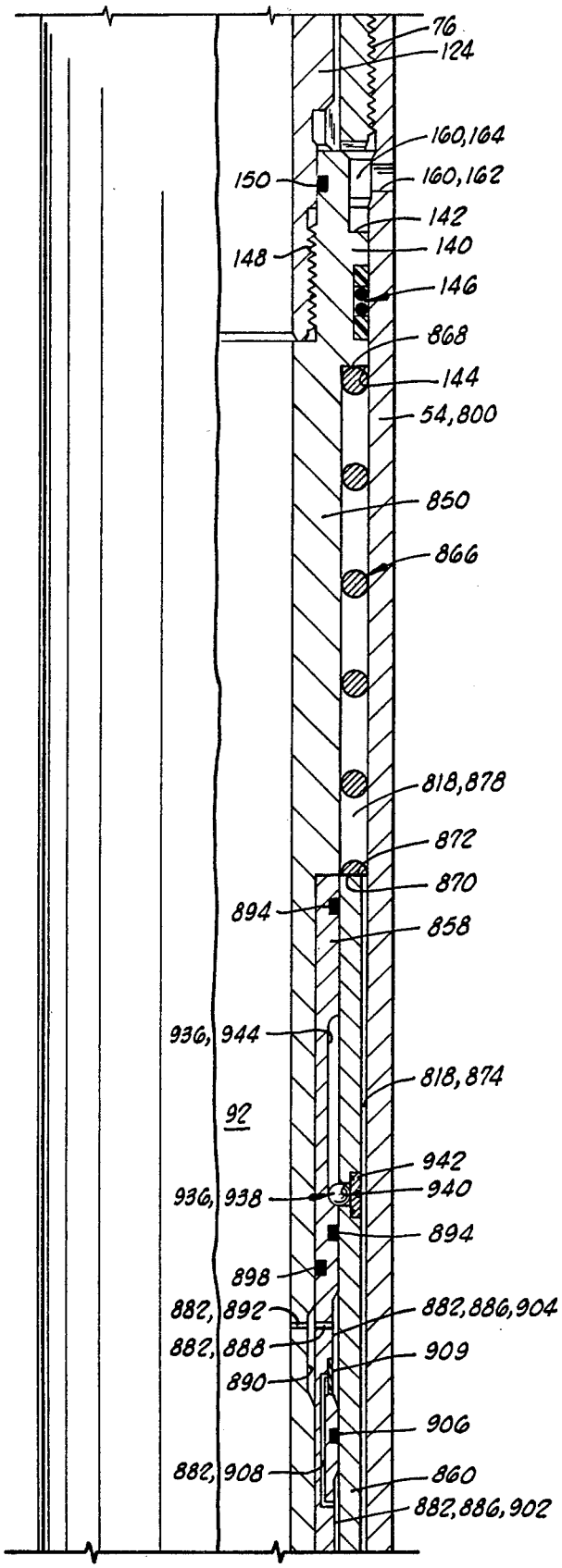
Figure 2D:
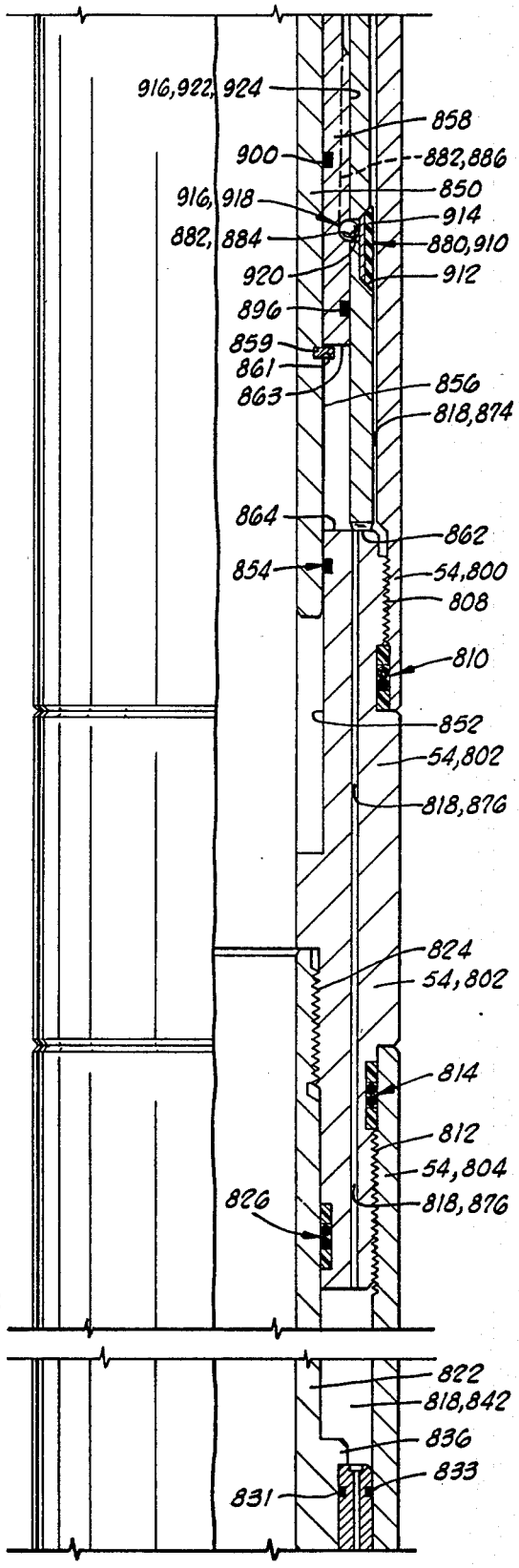

Referring now to FIG. 2C, a power piston 140 is slidably disposed in power housing section 800. Power piston 140 has a first side 142 and a second side 144. A double O-ring sliding seal means 146 is provided between power piston 140 and power housing section 62.

The ball valve actuating mandrel 124 is threadedly connected to power piston 140 at threaded connection 148 and O-ring seal 150 is provided therebetween.

Ball valve actuating mandrel 124 includes a plurality of radially outward extending splines 152 which engage radially inwardly extending splines 154 of first middle adaptor 60 to prevent relative rotation therebetween.

An intermediate portion of ball valve actuating mandrel 124, seen in FIG. 2B, is closely received within a bore 156 of first middle adaptor 60 and a double O-ring sliding seal means 158 is provided therebetween.

Disposed in the tester valve apparatus 32 is a first pressure conducting passage means 160 for communicating the well annulus 42 (see FIG. 1) with first side 142 of power piston 140. First pressure conducting passage means 160 includes a power port 162, and thus may be referred to as power passage means 160. First pressure conducting passage means 160 also includes an annular cavity 164 defined between power housing section 62 and the combined power piston 140 and ball valve actuating mandrel 124.

A second pressure conducting passage means 818 includes a balancing port 820 and a number of other passageways communicating the well annulus 42 with the second side 144 of power piston 140. Those other passageways are described in more detail below.

The second middle adaptor 802 has an upper end of a lower inner mandrel 822 threadedly attached thereto at 824 with a seal means being provided therebetween by O-ring sealing means 826.

Lower inner mandrel 822 has a lower end portion closely and sealingly received within an upper bore 823 of lower adaptor 806 with a seal being provided therebetween by O-ring seal means 825.

The lower inner mandrel 822 has an enlarged diameter outer cylindrical surface 828 at an intermediate portion thereof. A metering cartridge 830 is closely received about surface 828 and held in place relative to the lower inner mandrel 822 by a threaded collar 832 connected at threaded connection 834 to lower inner mandrel 822. The threaded collar 832 holds the metering cartridge in place against a radially outwardly ledge 836 at the upper end of enlarged diameter surface 828.

Inner and outer O-ring seals 831 and 833 seal between metering cartridge 830 and lower inner mandrel 822 and cartridge housing section 804, respectively.

The metering cartridge 830 has a cartridge passageway 838 disclosed therethrough which forms a portion of the second pressure conducting passage means 818.

A fluid restrictor 839, having a reduced diameter fluid orifice (not shown) located therein is disposed in cartridge passageway 838.

The metering cartridge 830 may be described as a retarding means 830 disposed in the second pressure conducting passage means 818 for delaying communication of a sufficient portion of an increase in well annulus pressure to the second side 144 of power piston 140 for a sufficient time to allow a pressure differential from the first side 142 to the second side 144 of power piston 140 to move said power piston 140 from a first position to a second position relative to the housing 54.

An annular cavity 840 is defined between the lower inner mandrel 822 and the cartridge housing section 804 below the metering cartridge 830. Annular cavity 840 is communicated with balancing port 820.

An annular cavity 842 is defined between lower inner mandrel 822 and cartridge housing section 804 above the metering cartridge 830.

The cartridge passageway 838 disposed through metering cartridge 830 communicates the annular cavities 840 and 842, all of which form a portion of the second pressure conducting passage means 818.

An annular floating shoe 844 is disposed in annular cavity 840 and it has inner and outer seals 846 and 848, respectively, slidingly sealingly engaging lower inner mandrel 822 and cartridge housing section 804, respectively. The annular floating shoe 844 merely serves to separate the fluid from well annulus 42 which enters balancing port 820 from the silicone oil or other working fluid contained in the annular cavity 840.

The portion of the second pressure conducting passage means 818 between second side 144 of power piston 140 and floating shoe 844 is preferably filled with silicone oil.

The tester valve 32 of FIGS. 2A–2E includes a positively mechanically actuated pressure relief means, which is further described below.

An operating mandrel 850 extends downward from power piston 140 and has its lower end closely and slidably received in an upper counter bore 852 of second middle adaptor 802. A sliding seal means is provided therebetween by O-ring 854.

Operating mandrel 850 has a reduced diameter outer cylindrical surface 856 defined on a lower portion thereof.

A ratchet mandrel 858 is closely and rotatably received about outer surface 856. Ratchet mandrel 858 is held in place relative to operating mandrel 850 by a locking ring 859 which fits in an annular groove 861 disposed in the outer surface of operating mandrel 850 immediately below the lower end 863 of ratchet mandrel 858.

A dump mandrel 860 is concentrically disposed between ratchet mandrel 858 and power and relief housing section 800. The lower end 862 of dump mandrel 860 abuts an upper end 864 of second middle adaptor 802.

A resilient biasing means 866, which is a coil compression spring 866, is operatively associated with power piston 140 for biasing the power piston 140 toward its first position. Coil compression spring 866 has an upper end 868 which engages second side 144 of power piston 140, and has a lower end 870 which engages an upper end 872 of dump mandrel 860.

An annular cavity 874 is defined between dump mandrel 860 and power and relief housing section 800, and forms a part of second pressure conducting passage means 818.

A longitudinal bore 876 disposed through the length of second middle adaptor 802 communicates annular cavity 874 with annular cavity 842.

An annular cavity 878 is defined between operating mandrel 850 and pressure and relief housing section 800 above the dump mandrel 860. Annular cavity 878 forms a part of second pressure conducting passage means 818 and is communicated with annular cavity 874 and with the second side 144 of power piston 140.

The operating mandrel 850, ratchet mandrel 858, and dump mandrel 860 are constructed to provide a pressure relief means 880. The pressure relief means 880 is communicated with the first portion of second pressure conducting passage means 818. The first portion of second pressure conducting means 818 is defined as the portion between the second side 144 of power piston 140 and the retarding means 830. Pressure relief means 880 is a means for relieving from said first portion of second pressure conducting passage means 818 a volume of fluid sufficient to permit power piston 140 to travel to its second position.

As with the other embodiments previously discussed, a central bore 92 of the tester valve 32 also functions as a fluid dump zone 92.

A fluid dump passage means 882 communicates the annular cavity 874 of second pressure conducting passage means 818 with the fluid dump zone 92 in following manner.

The fluid dump passage means 882 includes a first radial port 884 disposed through dump mandrel 860.

Fluid dump passage means 882 also includes a first flow space 886 defined between dump mandrel 860 and ratchet mandrel 858 and communicated with first port 884.

Fluid dump passage means 882 further includes a second port 888 disposed through ratchet mandrel 858 and communicated with first flow space 886.

Also included in fluid dump passage means 882 is a second flow space 890 defined between ratchet mandrel 858 and operating mandrel 850, said second flow space 890 being communicated with said second port 888.

Finally, fluid dump passage means 882 includes a third port 892 disposed through operating mandrel 850 and communicating said second flow space 890 with the central bore dump zone 92 of operating mandrel 850.

First and second annular seal means 894 and 896 are disposed between dump mandrel 860 and ratchet mandrel on opposite sides of both said first and second ports 884 and 888.

Third and fourth annular seal means 898 and 900 are disposed between ratchet mandrel 858 and operating mandrel 850 on opposite sides of third port 892.

The first flow space 886 is divided into first and second parts 902 and 904 by an annular divider seal means 906 disposed between dump mandrel 860 and ratchet mandrel 858. Said first and second parts 902 and 904 of first flow space 886 are communicated with first port 884 and second port 888, respectively.

Ratchet mandrel 858 has an intermediate flow passage 908 disposed therein communicating the first and second parts 902 and 904 of the first flow space 886.

A flapper-type check valve means 909 is connected to the ratchet mandrel 858 covering an upper end of intermediate flow passage 908 and is thus disposed between the second part 904 of first flow space 886 and the intermediate flow passage 908, for preventing fluid flow from the second part 904 of first flow space 886 backward into the intermediate flow passage 908. Flapper check valve means 909 permits flow from intermediate flow passage 908 into the second part 904 of first flow space 886.

The check valve 909 is necessary to prevent flow of fluid from the central bore 92 of tester valve 32 into the intermediate passage 908 of dump passage means 882 when pressure in the central bore 92 of the tester valve 32 is greater than the annulus pressure, such as for example is the case during an acidizing or fracturing job when the testing string 28 is actually being used to pump liquids down into a well to treat the well.

Pressure relief means 880 includes a fluid dump valve 910 which is disposed between the annular cavity 874 of second pressure conducting passage means 818 and the fluid dump passage means 882.

Fluid dump valve 910 is a flapper-type valve which has a flapper portion 914 movable between a closed position as illustrated isolating annular cavity 874 of second pressure conducting passage means 818 from the fluid dump passage means 882, and an open position wherein flapper portion 914 is moved radially outward to allow fluid flow from annular cavity 874 of second pressure conducting passage means 818 into and through the fluid dump passage means 882.

An operating means 916, operatively associated with power piston 140 and fluid dump valve 910, moves the fluid dump valve 910 to its open position as the power piston 140 starts to move from its said first position downward toward its second position. Operating means 916 also is a means for holding the fluid dump valve 910 in its said open position until the power piston 140 reaches its said second position, and then operating means 916 returns the fluid dump valve 910 to its said closed position after power piston 140 reaches its said second position.

The operating means 916 includes a spherical operating ball 918 which is closely and slidably received in the first port 884 and which engages a radially inner surface 920 of flapper-type fluid dump valve 910.

Operating means 916 further includes a cam means 922, operatively associated with the power piston 140 for movement therewith, for camming the operating ball 918 radially outward toward the flapper-type fluid dump valve 910 and thereby opening the flapper-type fluid dump valve 910 as the power piston 140 starts to move from its said first position toward its said second position.

Figure 4:
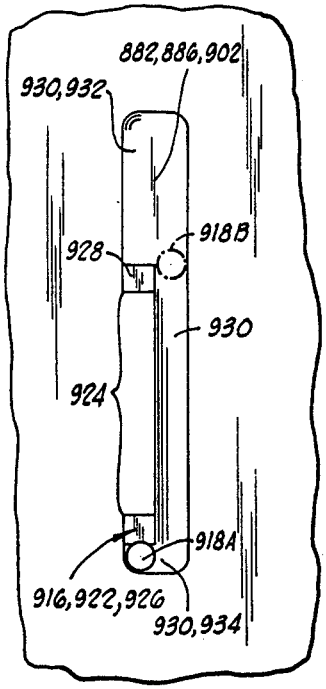
FIG. 4 is a layed out view of a cam surface and accompanying ball receiving groove disposed in the lower portion of ratchet mandrel 858 of the embodiment of FIGS. 2A–2E.

The cam means 922 of operating means 916 is best illustrated in FIG. 4 which is a layed out view thereof taken from the viewpoint of a viewer looking radially inward toward the radially outer surface of ratchet mandrel 858.

The cam means 922 includes a longitudinally oriented cam surface 924 having ramp portions 926 and 928 at the lower and upper ends thereof, respectively.

Cam means 916 further includes a return groove 930 oriented parallel to longitudinally oriented cam surface 924, which return groove has upper and lower transverse portions 932 and 934, respectively, which communicate the return groove 930 with the ramp portions 928 and 926.

The operation of the cam means 922 and the return groove 930 in cooperation with the operating ball 918 is described below.

Before describing that operation of the cam means 922, however, it is helpful to describe a ratchet means 936 which is operatively associated with the power piston 140 and the cam means 922, for disengaging the cam means 922 from the operating ball 918 and thereby allowing the flapper valve 910 to close after the power piston 140 reaches its second position.

Ratchet means 936 includes a radially inward extending ball lug 938 which is held in placed in a radial bore 940 of dump mandrel 860 by a threaded retainer 942.

The ball lug 938 is received within a ratchet groove 944 of ratchet means 936. The ratchet groove 944 is diposed in the radially outer surface of ratchet mandrel 858, and is best seen in FIG. 3 which is a layed out view of ratchet groove 944 as viewed by a viewer looking radially inward toward the radially outer surface of ratchet mandrel 858.

Originally, the operating lug 918 is in a position as illustrated in solid lines in FIG. 4 as 918A wherein it is in engagement with and directly below the lower ramp 926 of the cam means 922.

Figure 3:
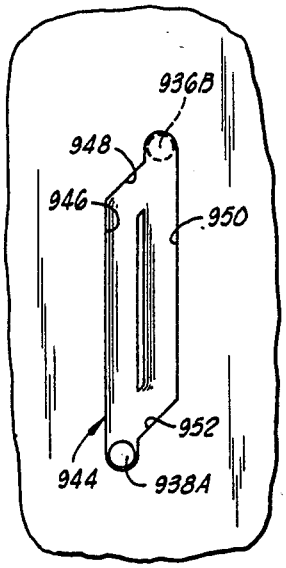
FIG. 3 is a layed out view of a ratchet groove disposed in ratchet mandrel 858 which comprises a portion of the ratchet means of the embodiment of FIGS. 2A–2E.

At that same time, the ball lug 938 of ratchet means 936 is in a position illustrated by the numeral 938A in FIG. 3 at the lower end of first longitudinal groove portion 946 of ratchet groove 944.

As the power piston 140 moves downward, the operating mandrel 850 and ratchet mandrel 858 move downward with the power piston 140.

As soon as this downward movement begins, the operating ball 918 rides up on the lower ramp 926 and onto the longitudinally oriented cam surface 924. Throughout that portion of the stroke of power piston 140 wherein the operating ball 918 is in engagement with the longitudinally oriented cam surface 924, the flapper dump valve 910 is held in an open position allowing fluid to be relieved from the annular cavity 874 of second pressure conducting passage means 818.

Throughout this downward movement of power piston 140, the ball lug 938 of ratchet means 936 travels upward through a first longitudinal groove portion 946 of ratchet groove 944 and then through an upper transverse groove portion 948 to a second upwardmost position relative to ratchet mandrel 858, which second position is designated in phantom lines by the numeral 936B.

Toward the end of the downward stroke of power piston 140, as the ball lug 938 of ratchet means 936 moves through the upper transverse groove portion 948 of ratchet groove 944, the ratchet mandrel 858 is rotated clockwise, as viewed from above, relative to power and relief housing section 800, thus rotating the longitudinally oriented cam surface 924 of cam means 922 out from under operating ball 918 allowing operating ball 918 to drop into an upwardmost position 918B, indicated in phantom lines, within the return groove 930 shown in FIG. 4.

Once the operating ball 918B drops into the return groove 930, the flapper dump valve 910 is allowed to return to a closed position.

When the power piston 140 is once again moved upward to its first position, the return groove 930 moves upward past the operating ball 918 while a corresponding second longitudinal groove portion 950 of ratchet groove means 944 moves upward past ball lug 938, and finally when ball lug 938 engages a lower transverse groove portion 952 of ratchet groove 944, the ratchet mandrel 858 is rotated counter-clockwise as viewed from above relative to power and relief housing section 800 thus returning the ball lug 938 to the position 938A illustrated in FIG. 3 and returning the operating ball 918 to the position 918A illustrated in FIG. 4.

Referring now to FIG. 2B, a releasable holding means 954, is operatively associated with power piston 140, for releasably preventing the power piston 140 from returning to its first position.

The releasable holding means 954 includes an indentation 956 disposed in actuating mandrel 124, and a holding pin 958 sildably disposed in a radial bore 960 of first middle adaptor 60 of tool housing 54.

A resilient pin biasing means 962, which is a coil compression spring 962, biases the holding pin 958 radially inward.

The indentation 956 and holding pin 958 are so arranged and constructed that when the power piston 140 is in its said second position, the indentation 956 is aligned with holding pin 958 so that the holding pin 958 is moved into the indentation 956 by the pin biasing means 962 so that the power piston 140 is releasably held in its second position.

The coil spring 866 is not strong enough to overcome the holding force of releasable holding means 954. Coil spring 866 must be assisted by an upward pressure differential across power piston 140 to return power piston 140 to its first position.

In the tester valve 32, the second pressure conducting passage means 818 is always in fluid communication throughout its length with balancing port 820. Thus, the second pressure conducting passage means 818 itself functions as a run-in balance means 818 for allowing well annulus pressure to sufficiently balance across power piston 140 as tester valve 32 is run into a well so that a pressure differential from first side 142 to second side 144 of power piston 140 is never sufficient to overcome biasing spring 866 and prematurely move power piston 140 to its second position as tester valve 32 is run into the well.

Manner Of Operation Of The Tester Valve Of FIGS. 2A–2E

The manner of operation of the tester valve 32 shown in FIGS. 2A–2E, 3 and 4 is generally as follows.

The tester valve 32 is first set up in the orientation illustrated in FIGS. 2A–2E and is made up in the testing string 28 in the position designated by the numeral 32 in FIG. 1. Then the testing string including the tester valve 32 is run into the well defined by well casing 16, with the ball valve means 90 in its closed position closing the central bore flow passage 92 of the tester valve 32, and with the power piston 140 in its first position as illustrated.

The coil compression spring 866 resiliently biases the power piston 140 towards its first position.

As the tester valve 32 is run into the well, the increase in hydrostatic well annulus pressure, which occurs with increasing depth in the well, is sufficiently balanced across the power piston 140 so that a pressure differential from the first side 142 to the second side 144 of power piston 140 is never sufficient to overcome the resilient biasing means 866 and prematurely move the power piston 140 to its second position.

This balancing of the increase in hydrostatic well annulus pressure as the tester valve 32 is run into the well is accomplished by the fact that the second pressure conducting passage means 818 is always in fluid communication throughout its length with the balancing port 820.

After the tester valve 32 is lowered into place in the well to the position illustrated in FIG. 1, the packer means 44 is set in the well casing 16 to separate the well annulus 42 into an upper portion above the packer means 44 and a lower portion 48 below the packer means 44.

Both the power port 162 and the balancing port 820, and the first and second pressure conducting passage means 160 and 818, respectively, are communicated with the upper portion of the well annulus 42 above the packer means 44.

The central bore flow passage 92 of the tester valve 32 is communicated with the lower portion 48 of the well annulus 42 below the packer means 44.

After the packer means 44 has been set, an increase in annulus fluid pressure is applied to the annulus fluid in the upper portion of the well annulus 42 above the packer means 44.

This increase in annulus fluid pressure is substantially immediately communicated to the first side 142 of power piston 140 through the first pressure conducting passage means 160.

The metering cartridge retarding means 830 delays communication of a sufficient portion of this increase in annulus fluid pressure to the second side 144 of the power piston 140 for a sufficient time to allow a pressure differential from the first side 142 to the second side 144 of power piston 140 to move the power piston 140 to its open position.

As soon as the power piston 140 begins to move downward, the cam means 922 cams the operating ball 918 radially outward to open the flapper dump valve 910.

Then as the power piston 140 continues to move downward from its first position to its second position, fluid from the second pressure conducting passage means 818 is relieved through the dump valve 910 and through the dump passage 882 to the dump zone 92. The volume of fluid relieved is equal to the volume of fluid displaced by the power piston 140 as it moves from its first position to its second position.

As the power piston 140 reaches the bottom end of its downward stroke, the ratchet means 944 rotates the ratchet mandrel 858 causing the operating ball 918 to move transversely off of the longitudinally oriented cam surface 924 so that it drops into the return groove 930.

As the power piston 140 moves to its second position, the ball valve means 90 is rotated to its open position wherein the bore 94 of ball 108 is aligned with the central bore flow passage 92 of tester valve 32.

The cartridge type retarding means 830 allows an additional portion of the increase in the well annulus pressure to be communicated to the second side 144 of the power piston 140 after the power piston 140 is moved to its second position, thus ultimately allowing the increase in well annulus pressure to substantially entirely balance across the power piston 140.

In the tester valve 32, the coil spring biasing means 866 is so constructed that acting by itself it is not strong enough to overcome the holding force of the releasable holding means 954. This is necessary because, in the tester valve 32, the increase in well annulus pressure will ultimately, after a few minutes, completely balance across the power piston 140 so that there is no downward pressure differential acting on the power piston 140.

To reclose the ball valve means 90 in the tester valve 32, a decrease in annulus fluid pressure is rapidly applied to the well annulus 42, thus creating an upward pressure differential across the power piston 140 because of the fact that the metering cartridge retarding means 830 creates a time delay in communication of this decrease in well annulus pressure to the second side 144 of power piston 140. Thus for a short period of time there is an upward pressure differential acting across power piston 140. This upward pressure differential in combination with the upward biasing force of coil compression spring 866 is sufficient to overcome the holding force of releasable holding means 954, thus providing a slight upward movement of power piston 140 sufficient to disengage the holding pin 958 at which point the coil compression spring 866 itself will continue to move the power piston 140 upward to its first position.

Figure 2E:
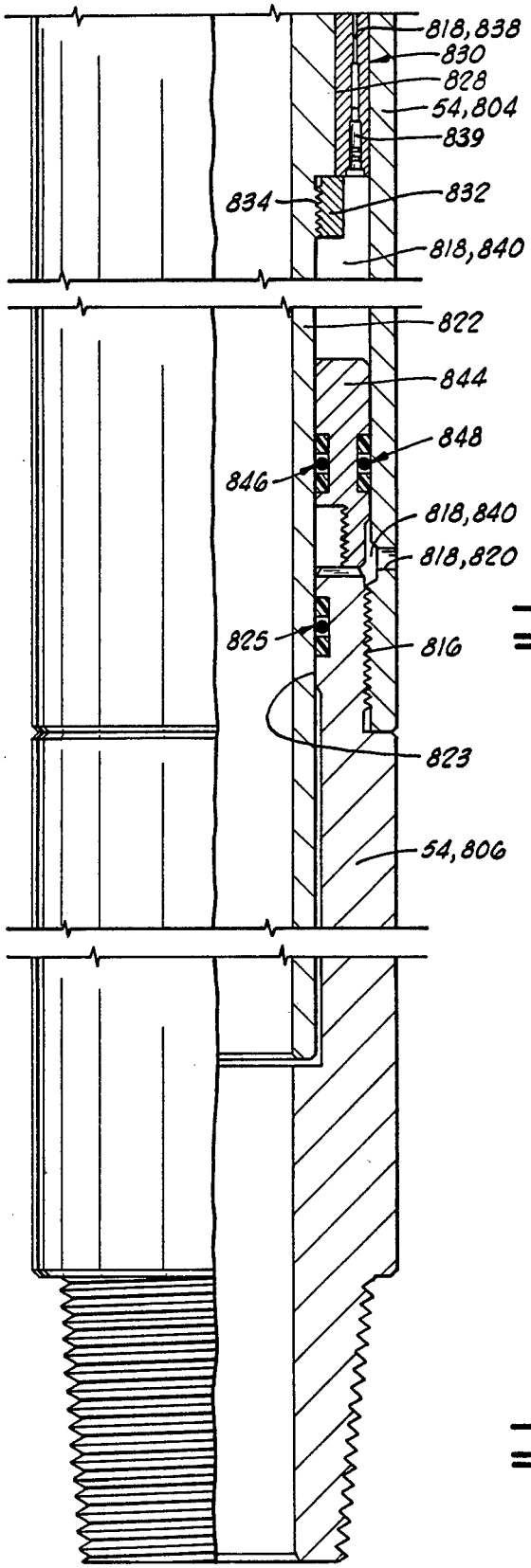

As the power piston 140 moves upward to return to its first position, the annular floating shoe 844 shown in FIG. 2E is displaced upward to account for the volume of fluid which was displaced on the downward movement of the power piston 140.

The number of times which the tester valve 32 can be cycled between the closed and open positions of ball valve means 90 is determined by the volume of fluid in the annular cavity 840 above the annular floating shoe 844. When the annular floating shoe 844 engages the threaded collar 832, the tester valve 32 can no longer be operated. It must then be removed from the well and refilled with fluid.

Thus, it is seen that the methods and apparatus of the present invention readily achieve the ends and advantages mentioned as well as those inherent therein. While certain preferred embodiments of the present invention have been illustrated for the purposes of the present disclosure, numerous changes in the arrangement and construction of parts may be made by those skilled in the art which changes are encompassed within the scope and spirit of the present invention as defined by the appended claims.

What is claimed is:

1. An annulus pressure responsive downhole tool apparatus, comprising:

a tool housing;

a power piston slidably disposed in said housing;

a first pressure conducting passage means for communicating a well annulus with a first side of said power piston;

a second pressure conducting passage means for communicating said well annulus with a second side of said power piston;

retarding means, disposed in said second pressure conducting passage means, for delaying communication of a sufficient portion of an increase in well annulus pressure to said second side of said power piston for a sufficient time to allow a pressure differential from said first side to said second side of said power piston to move said power piston from a first position to a second postion relative to said housing; and pressure relief means, communicated with a first portion of said second pressure conducting passage means between said second side of said power piston and said retarding means, for relieving from said first portion of said second pressure conducting passage means a volume of fluid sufficient to permit said power piston to travel to its said second position, said pressure relief means including:

a fluid dump zone;

a fluid dump passage means for communicating said first portion of said second pressure conducting passage means with said fluid dump zone;

a fluid dump valve, disposed between said first portion of said second pressure conducting passage means and said fluid dump passage means, said dump valve being movable between a closed position isolating said first portion of said second pressure conducting passage means from said fluid dump passage means and an open position wherein fluid is allowed to flow from said first portion of said second pressure conducting passage means to said fluid dump passage means; and operating means operatively associated with said power piston and said fluid dump valve, for moving said fluid dump valve to its said open position as said power piston starts to move from its said first position toward its said second position, for holding said fluid dump valve in its said open position until said power piston reaches its said second position, and for returning said fluid dump valve to its said closed position after said power piston reaches its said second position.

2. The apparatus of claim 1, wherein:

said fluid dump valve is a flapper valve.

3. The apparatus of claim 2, wherein said operating means comprises:

an operating ball engaging said flapper valve; and cam means, operatively associated with said power piston for movement therewith, for camming said operating ball toward said flapper valve and thereby opening said flapper valve as said power piston starts to move from its said first position toward its said second position.

4. The apparatus of claim 3, further comprising:

ratchet means, operatively associated with said power piston and said cam means, for disengaging said cam means from said operating ball and thereby allowing said flapper valve to close after said power piston reaches its said second position.

5. The apparatus of claim 1, further comprising:

check valve means, disposed in said fluid dump passage means, for permitting fluid flow from said first portion of said second pressure conducting passage means to said dump zone, and for preventing fluid flow from said dump zone to said first portion of said second pressure conducting passage means.

6. The apparatus of claim 5, wherein:

said check valve means is a flapper valve.

7. The apparatus of claim 1, wherein:

said second pressure conducting passage means is always open to pressure communication along an entire length thereof from said second side of said power piston to said well annulus when said apparatus is run into said well, so that well annulus pressure is allowed to sufficiently balance across said power piston so that a pressure differential from said first side to said second side of said power piston is never sufficient to prematurely move said power piston to its said second position as said apparatus is being run into said well.

8. An annulus pressure responsive downhole tool apparatus, comprising:

a tool housing including power section housing;

a power piston slidably disposed in said power section housing, and movable relative to said power section housing from a first position to a second position;

a first pressure conducting passage means for communicating a well annulus with a first side of said power piston;

a second pressure conducting passage means for communicating said well annulus with a second side of said power piston;

a cylindrical operating mandrel extending longitudinally from said second side of said power piston, said operating mandrel being concentrically disposed within said power section housing;

a ratched mandrel closely, concentrically and rotatably received about said operating mandrel;

a dump mandrel, concentrically disposed between said ratchet mandrel and said power section housing, said second pressure conducting passage means being at least partially defined by an annular cavity between said dump mandrel and said power section housing;

a fluid dump passage means, disposed through said dump mandrel, said ratchet mandrel and said operating mandrel, and communicating said annular cavity with a central bore of said operating mandrel;

a fluid dump valve, connected to said dump mandrel and movable between a closed position, isolating said annular cavity from said fluid dump passage means, and an open position wherein fluid is allowed to flow from said annular cavity to said fluid dump passage means; and operating means, operatively associated with said ratchet mandrel and said fluid dump valve, for moving said fluid dump valve to its open position as said power piston starts to move from its said first position toward its said second position.

9. The apparatus of claim 8, wherein said fluid dump passage means includes:

a first port disposed through said dump mandrel;

a first flow space defined between said dump mandrel and said ratchet mandrel and communicated with said first port;

a second port disposed through said ratchet mandrel and communicated with said first flow space;

a second flow space defined between said ratchet mandrel and said operating mandrel, and communicated with said second port;

a third port disposed through said operating mandrel and communicating said second flow space with said central bore of said operating mandrel.

10. The apparatus of claim 9, further comprising:

first and second annular seal means disposed between said dump mandrel and said ratchet mandrel on opposite sides of both of said first and second ports; and third and fourth annular seal means disposed between said ratchet mandrel and said operating mandrel on opposite sides of said third port.

11. The apparatus of claim 9, wherein:

said first flow space is divided into first and second parts by an annular divider seal means diposed between said dump mandrel and said ratchet mandrel, said first and second parts being communicated with said first and second ports, respectively;

said ratchet mandrel has an intermediate flow passage disposed therein communicating said first and second parts of said first flow space; and said apparatus further includes a flapper check valve means, connected to said ratchet mandrel and disposed between said second part of said first flow space and said intermediate flow passage, for preventing fluid flow from said second part of said first flow space into said intermediate flow passage.

12. The apparatus of claim 9, wherein said operating means comprises:

an operating ball slidably disposed in said first port and engaging said fluid dump valve, said first port being radially disposed through said dump mandrel; and cam means, disposed on said ratchet mandrel, for camming said operating ball radially outward to thereby open said fluid dump valve as said power piston starts to move from its said first position toward its said second position.

13. The apparatus of claim 8, wherein:

said fluid dump passage means includes a first port disposed radially through said dump mandrel;

said fluid dump valve is a flapper valve covering a radial outer opening of said first port; and said operating means includes:

an operating ball slidably disposed in said first port and engaging said flapper valve; and cam means, disposed on said ratchet mandrel, for camming said operating ball radially outward to thereby open said flapper valve as said power piston starts to move from its said first position toward its said second position.

14. The apparatus of claim 13, further comprising:

ratchet means, operatively associated with said dump mandrel and said ratchet mandrel, for rotating said ratchet mandrel relative to said dump mandrel and for thereby disengaging said cam means from said operating ball to thereby close said flapper valve when said power piston reaches its said second position.

15. The apparatus of claim 14, wherein:

said ratchet mandrel includes a ball receiving return groove for receiving said operating ball when said flapper valve is closed and for allowing said power piston to return to its first position while said flapper valve remains closed.

16. The apparatus of claim 8, further comprising:

check valve means, disposed in said fluid dump passage means, for preventing flow of fluid from said central bore of said operating mandrel through said fluid dump passage means.

17. The apparatus of claim 8, wherein:

said second pressure conducting passage means is always open to pressure communication along an entire length thereof from said second side of said power piston to said well annulus when said apparatus is run into said well, so that well annulus pressure is allowed to sufficiently balance across said power piston so that a pressure differential from said first side to said second side of said power piston is never sufficient to prematurely move said power piston to its said second position as said apparatus is being run into said well.

18. An annulus pressure responsive downhole tool valve apparatus, comprising:

a housing;

a power piston having first and second sides, said power piston being slidably disposed in said housing and movable between first and second positions relative to said housing;

a power passage means for communicating a well annulus with said first side of said power piston;

a low pressure zone, defined within said housing, and communicated with said second side of said power piston; and pressure relief means, communicated with said low pressure zone, for relieving from said low pressure zone a volume of fluid sufficient to permit said power piston to travel from said first position thereof to said second position thereof, said travel being in a direction from said first side toward said second side of said power piston, said pressure relief means including:

a fluid dump zone;

a fluid dump passage means communicating said low pressure zone with said fluid dump zone;

a fluid dump valve disposed between said low pressure zone and said fluid dump passage means, said dump valve being movable between a closed position isolating said low pressure zone from said fluid dump passage means, and an open position wherein fluid is allowed to flow from said low pressure zone through said fluid dump passage means to said fluid dump zone; and operating means, operatively associated with said power piston and said fluid dump valve, for moving said fluid dump valve to its said open position as said power piston starts to move from its said first position toward its said second position, for holding said fluid dump valve in its said open position until said power piston reaches its said second position, and for returning said fluid dump valve to its said closed position after said power piston reaches its said second position.

19. The apparatus of claim 18, wherein:

said fluid dump valve is a flapper valve; and said apparatus further comprises:

an operating ball engaging said flapper valve; and cam means, operatively associated with said power piston for movement therewith, for camming said operating ball toward said flapper valve and thereby opening said flapper valve as said power piston starts to move from its said first position toward its said second position.

20. The apparatus of claim 19, further comprising:

ratchet means, operatively associated with said power piston and said cam means, for disengaging said cam means from said operating ball and thereby allowing said flapper valve to close after said power piston reaches its said second position.

* * * * *